United States Patent [19]

Partridge et al.

[11] 4,362,660

[45] Dec. 7, 1982

[54] MERCURIC IODATE PRECIPITATION FROM RADIOIODINE-CONTAINING OFF-GAS SCRUBBER SOLUTION

[75] Inventors: Jerry A. Partridge; Gail P. Bosuego, both of Richland, Wash.

[73] Assignee: The United States of America as represented by the United States Department of Energy, Washington, D.C.

[21] Appl. No.: 168,979

[22] Filed: Jul. 14, 1980

[51] Int. Cl.[3] ..... G21F 9/04; G21F 9/02

[52] U.S. Cl. ..... 252/631; 252/630; 423/249

[58] Field of Search ..... 423/249; 252/630, 631

[56] References Cited

U.S. PATENT DOCUMENTS 3,752,876 8/1973 Cathers et al. ..... 423/240

3,852,407 12/1974 Schmitt et al. ..... 423/240

4,162,206 7/1979 Burger et al. ..... 204/94

4,275,045 6/1981 Anav et al. ..... 423/249

OTHER PUBLICATIONS

Hackh's Chemical Dictionary, Julius, Grant Editor, 4th Ed., p. 172.

*Primary Examiner*—Benjamin R. Padgett
*Assistant Examiner*—M. A. Thexton
*Attorney, Agent, or Firm*—Robert Southworth, III; Richard E. Constant; Richard G. Besha

[57] ABSTRACT

Mercuric nitrate-nitric acid scrub solutions containing radioiodine may be reduced in volume without excessive loss of volatile iodine. The use of concentrated nitric acid during an evaporation process oxidizes the mercury-iodide complex to a less volatile mercuric iodate precipitate.

4 Claims, No Drawings

MERCURIC IODATE PRECIPITATION FROM RADIOIODINE-CONTAINING OFF-GAS SCRUBBER SOLUTION

The United States has rights in this invention pursuant to Contract No. EY-76-C-14-2170 between the U.S. Department of Energy and Westinghouse Electric Corporation.

FIELD OF THE INVENTION

This invention relates to a process for reducing the volume of iodine-containing mercuric nitrate-nitric acid off-gas scrubber solutions and more particularly to such a process minimizing the loss of volatile iodine.

BACKGROUND OF THE INVENTION

Fission product iodine-127, iodine-129, and iodine-131 are produced in the fuel pins of a nuclear reactor. This iodine remains trapped when the irradiated fuel is processed. During fuel dissolution and subsequent processing, this iodine may be volatilized in the process off-gas. Because of the long half-life of iodine-129, the recovery and disposal of radioiodine from the off-gas streams is important to prevent any detrimental effect to the public.

One process for removing radioiodine from such off-gas streams involves the use of scrubbing solutions containing nitric acid and mercuric nitrate and is known as the Mercurex process. This scrub solution, which generally contains about 6 to 10 molar nitric acid and about 0.1 to 0.4 molar mercuric nitrate forms strong complexes between mercury and iodine as well as decomposing organic iodides to a recoverable form.

In this process, it is useful to heat the scrub solution to boiling before it is recycled back to the scrub column. At high acid concentrations, this step converts the mercuric iodide complex to insoluble (and less volatile) mercuric iodate. Unfortunately, heating the scrub solution to boiling results in the volatilization of the radioiodine present in the solution requiring further off-gas scrubbing.

One process which has been developed to overcome this volatilization of some of radioiodine involves the electrolytic conversion of the mercuric iodide complex to mercuric iodate. This process, as described in U.S. Pat. No. 4,162,206 to Burger et al., utilizes an electric current of about 0.1 to 1 amp/cm$^2$ in an electrolytic cell to perform the conversion. This electrolytic step may be time-consuming as well as requiring specialized equipment.

SUMMARY OF THE INVENTION

We have developed a process for the separation of iodine from nitric acid-mercuric nitrate scrubbing solutions which eliminated the problems attendant with the prior art processes. By our process, the iodine containing scrub solution is added to hot concentrated nitric acid. The mixture is further heated to effect evaporation of the nitric acid and precipitation of mercuric iodate.

In view of the above, it is an object of this invention to provide a method for reducing the volume of intermediate level liquid waste containing radioiodine of mercuric nitrate-nitric acid scrub solution with minimal or no loss of radioiodine from the solution.

It is a further object of this invention to provide a process for reducing the volume of radioiodine containing mercuric nitrate-nitric acid scrub solutions which achieves an iodine decontamination factor ranging up to 20,000.

It is a further object of this invention to provide a process for reducing the volume of radioiodine containing mercuric nitrate-nitric acid scrub solutions wherein iodine is oxidized to iodate and precipitates as mercuric iodate during the concentration process.

Various other objects and advantages will appear from the following description and the most novel features will be particularly pointed out hereinafter in connection with the appended claims. It will be understood that various changes in the details and materials as well as in the process steps which are herein described in order to explain the nature of the invention may be made by those skilled in the art without departing from the scope of this invention.

The invention comprises disposing nitric acid in a vessel or evaporator, heating the nitric acid, and feeding off-gas scrub solution of mercuric nitrate-nitric acid containing iodine into the evaporator so that the iodine is oxidized to non-volatile iodate and precipitated as insoluble mercuric iodate.

DETAILED DESCRIPTION

Concentrated nitric acid is fed into an evaporator and heat is applied to the evaporator to cause the acid to boil. The nitric acid is preferably at an initial concentration of from 15 to 16 molar. Scrub solution composed of mercuric nitrate-nitric acid and containing iodine is then fed into the evaporator at a rate approximately equal to the rate of condensate removal from the evaporator. The iodine in the scrub solution is oxidized to iodate and precipitates as mercuric iodate during the concentration process. The use of the high initial nitric acid concentration followed by the gradual addition of scrub solution insures rapid and efficient oxidation of the iodine thus minimizing losses due to volatility.

Scrub solutions are at various concentration but generally they may range from about 6 to 10 molar nitric acid, about 0.1 to 0.4 molar mercuric nitrate, and contain about 0.01 molar iodine.

Table I illustrates the amount of iodine volatilized during direct evaporation of 6 to 11 molar nitric acid scrub solutions during 10 fold concentration. The heavy iodine losses are characteristic of evaporation as practiced without using the method of our invention.

TABLE I

| | Initial Composition, M | | | |
|---|---|---|---|---|
| Run | $HNO_3$ | $Hg(NO_3)_2$ | $I^-$ | % Iodine Volatilized |
| A | 6 | 0.1 | 0.01 | 13 |
| B | 6 | 0.1 | 0.01 | 16 |
| C | 11 | 0.1 | 0.01 | 9 |

A series of tests of the method of the present invention were run in which about 500 ml of nitric acid solution was placed in a boiling flush and heated to boiling (about 120° C.). Scrub solution was added to the flask at approximately the rate of evaporation (from 1.2 to 2.6 ml/min.). The condensate was collected and analyzed for iodine content to determine the decontamination factor (DF). The decontamination factor (DF) is defined as the iodine concentration in the feed solution divided by the iodine concentration in the condensate.

EXAMPLE I

Initial Solution in Boiling Flask:
495 ml of 15M $HNO_3$—0.10M $Hg^{++}$—. .010M $I^-$
Feed to Boiling Flask:
4.0 l of 6M $HNO_3$—0.10M $Hg^{++}$—0.010M $I^-$

| Incremental Condensate Collected, ml | Cumulative Condensate Collected, ml | ($H^+$) in Incremental Sample, M | Incremental Iodine D.F. |
|---|---|---|---|
| 234 | 234 | 12.1 | 1,000 |
| 290 | 524 | 8.5 | 6,300 |
| 248 | 772 | 5.9 | 2,900 |
| 254 | 1,026 | 5.2 | 1,700 |
| 188 | 1,214 | 6.8 | 8,600 |
| 360 | 1,574 | 6.3 | 9,300 |
| 252 | 1,826 | 6.6 | 5,700 |
| 188 | 2,014 | 7.0 | 20,000 |
| 316 | 2,330 | 7.2 | 10,000 |
| 282 | 2,612 | 7.2 | 20,000 |
| 336 | 2,948 | 7.0 | 12,000 |
| 288 | 3,236 | 6.1 | 9,000 |
| 324 | 3,560 | 5.9 | 9,700 |
| 196 | 3,756 | 5.8 | 7,800 |
| 122 | 3,878 | 6.5 | 6,300 |
| 322 | 4,200 | 10.4 | 7,300 |
| 142 | 4,342 | 13.1 | 10,600 |
| Final concentrate volume: | | | 100 ml |
| Overall concentration factor: | | | 45 |
| Overall iodine D.F.: | | | 5,000 |

EXAMPLE II

Initial Solution in Boiling Flask:
500 ml of 15M $HNO_3$—0.10M $Hg^{++}$—.010M $I^-$
Feed to Boiling Flask:
4.11 of 6M $HNO_3$—0.10M $Hg^{++}$—0.010M $I^-$

| Incremental Condensate Collected, ml | Cumulative Condensate Collected, ml | ($H^+$) in Incremental Sample, M | Incremental Mercury D.F. |
|---|---|---|---|
| 202 | 202 | 12.6 | 2,300 |
| 232 | 434 | 8.0 | 20,000 |
| 244 | 678 | 6.4 | 14,000 |
| 298 | 976 | 5.3 | 20,000 |
| 280 | 1,256 | 5.3 | 20,000 |
| 280 | 1,536 | 6.0 | 7,700 |
| 282 | 1,818 | 6.7 | 5,100 |
| 340 | 2,158 | 7.3 | 20,000 |
| 316 | 2,474 | 6.1 | 20,000 |
| 304 | 2,778 | 5.0 | 16,000 |
| 260 | 3,038 | 5.5 | 4,100 |
| 328 | 3,366 | 6.0 | 3,300 |
| 204 | 3,570 | 6.6 | 2,800 |
| 328 | 3,898 | 5.5 | 16,000 |
| 290 | 4,188 | 6.5 | 2,600 |
| 280 | 4,468 | 10.7 | 1,700 |
| Final concentrate volume: | | | 120 ml |
| Overall concentration factor: | | | 38 |

EXAMPLE III

Initial Solution in Boiling Flask:
500 ml of 15.8M $HNO_3$
Feed to Boiling Flask:
4.0 l of 6M $HNO_3$—0.40M $Hg^{++}$—0.06M $I^-$

| Incremental Condensate Collected, ml | Cumulative Condensate Collected, ml | ($H^+$) in Incremental Sample, M | Incremental Iodine D.F. |
|---|---|---|---|
| 236 | 236 | 12.7 | 970 |
| 232 | 468 | 8.2 | 210 |
| 236 | 704 | 7.2 | 150 |
| 270 | 974 | 6.4 | 120 |
| 257 | 1,231 | 6.4 | 90 |
| 258 | 1,489 | 6.3 | 120 |
| 250 | 1,739 | 6.4 | 150 |
| 275 | 2,014 | 5.9 | 108 |
| 290 | 2,304 | 6.1 | 102 |
| 263 | 2,567 | 6.5 | 130 |
| 300 | 2,867 | 6.6 | 120 |
| 298 | 3,165 | 6.3 | 130 |
| 288 | 3,453 | 6.4 | 120 |

EXAMPLE III-continued

Initial Solution in Boiling Flask:
500 ml of 15.8M $HNO_3$
Feed to Boiling Flask:
4.0 l of 6M $HNO_3$—0.40M $Hg^{++}$—0.06M $I^-$

| Incremental Condensate Collected, ml | Cumulative Condensate Collected, ml | ($H^+$) in Incremental Sample, M | Incremental Iodine D.F. |
|---|---|---|---|
| 326 | 3,779 | 6.4 | 106 |
| 207 | 3,986 | 6.4 | 108 |
| 276 | 4,262 | 9.8 | 104 |
| Final concentrate volume: | | | 212 ml |
| Overall concentration factor: | | | 19 |

EXAMPLE IV

Initial Solution in Boiling Flask:
500 ml of 15.8M $HNO_3$
Feed to Boiling Flask:
4.0 l of 6M $HNO_3$—0.40M $Hg^{++}$—0.06M $I^-$

| Incremental Condensate Collected, ml | Cumulative Condensate Collected, ml | ($H^+$) in Incremental Sample, M | Incremental Iodine D.F. |
|---|---|---|---|
| 255 | 255 | 14.0 | 2,400 |
| 303 | 558 | 11.4 | 2,500 |
| 286 | 844 | 10.9 | 1,500 |
| 275 | 1,119 | 10.7 | 2,500 |
| 288 | 1,407 | 10.7 | 1,700 |
| 274 | 1,681 | 10.5 | 2,100 |
| 255 | 1,936 | 10.6 | 2,000 |
| 264 | 2,200 | 10.7 | 3,800 |
| 646 | 2,846 | 10.7 | 2,000 |
| 326 | 3,172 | 9.9 | 1.300 |
| 321 | 3,493 | 10.1 | 1,800 |
| 228 | 3,721 | 10.7 | 4,800 |
| 316 | 4,037 | 10.4 | 13,500 |
| 272 | 4,309 | 11.8 | 30,000 |
| Final concentrate volume: | | | 160 ml |
| Overall concentration factor: | | | 25 |

EXAMPLE V

Initial Solution in Boiling Flask:
500 ml of 15.8M $HNO_3$
Feed to Boiling Flask:
3.01 of 10M $HNO_3$—0.40M $Hg^{++}$—0.06M $I^-$

| Incremental Condensate Collected, ml | Cumulative Condensate Collected, ml | ($H^+$) in Incremental Sample, M | Incremental Iodine D.F. |
|---|---|---|---|
| 292 | 292 | 13.99 | 6,700 |
| 273 | 565 | 11.14 | 3,400 |
| 282 | 847 | 10.58 | 5,400 |
| 308 | 1,155 | 10.24 | 30,000 |
| 296 | 1,451 | 11.14 | 30,000 |
| 263 | 1,714 | 10.24 | 11,500 |
| 323 | 2,037 | 10.46 | 2,500 |
| 287 | 2,324 | 10.58 | 2,500 |
| 277 | 1,601 | 10.69 | 3,500 |
| 182 | 2,783 | 10.46 | 14,600 |
| 260 | 3,043 | 12.80 | 4,000 |
| 283 | 3,326 | 12.28 | 2,600 |
| Overall concentration factor: | | | 20 |

As can be seen from the above discussions and examples, the process of this invention provides an efficient method of reducing the volume of iodine containing mercuric nitrate-nitric acid scrub solutions while minimizing the loss of volatile iodine.

We claim:

1. A process for reducing the volume of a radioiodine containing mercuric nitrate-nitric acid off-gas scrubber solution comprising:

(a) first placing 15 to 16 molar nitric acid in a vessel;

(b) heating said nitric acid to boiling temperature; and then continuously and simultaneously (c) introducing said scrubber solution into said vessel and mixing with nitric acid; and (d) further heating the resultant mixture effecting evaporation of said mixture, oxidation by said nitric acid of said iodine to non-volatile iodate, and precipitation of said iodate as insoluble mercuric iodate;

wherein said introduction of said scrubber solution and said evaporation occur at rates continuously maintaining said mixture at a nitric acid concentration of about 15 to 16 molar.

2. The process of claim 1 wherein said off-gas scrub solution has a nitric acid concentration of about 6 to 10 molar, a mercury nitrate concentration about 0.1 to 0.4 molar, and an iodine concentration about 0.01 molar.

3. The process of claim 1 wherein said scrubber solution is reduced in volume about 10 to 50 times.

4. The process of claim 1 wherein said evaporated mixture is condensed and said process provides a decontamination factor defined as the iodine concentration in the scrubber solution divided by the iodine concentration in the condensate of about 100 to 20,000.

* * * * *